US010510283B2

(12) United States Patent
Wang et al.

(10) Patent No.: US 10,510,283 B2
(45) Date of Patent: Dec. 17, 2019

(54) GRAYSCALE SIGNAL COMPENSATION UNITS, GRAYSCALE SIGNAL COMPENSATION METHODS, SOURCE DRIVERS, AND DISPLAY APPARATUSES

(71) Applicants: BOE Technology Group Co., Ltd., Beijing (CN); Beijing BOE Display Technology Co., Ltd., Beijing (CN)

(72) Inventors: Jianming Wang, Beijing (CN); Liugang Zhou, Beijing (CN); Ming Chen, Beijing (CN); Jieqiong Wang, Beijing (CN); Shou Li, Beijing (CN); Chao Zhang, Beijing (CN); Hao Zhu, Beijing (CN)

(73) Assignees: BOE TECHNOLOGY GROUP CO., LTD., Beijing (CN); BEIJING BOE DISPLAY TECHNOLOGY CO., LTD, Beijing (CN)

( * ) Notice: Subject to any disclaimer, the term of this patent is extended or adjusted under 35 U.S.C. 154(b) by 92 days.

(21) Appl. No.: 15/795,867

(22) Filed: Oct. 27, 2017

(65) Prior Publication Data

US 2018/0268753 A1 Sep. 20, 2018

(30) Foreign Application Priority Data

Mar. 20, 2017 (CN) ..... 2017 1 0166457

(51) Int. Cl.
*G09G 3/20* (2006.01)

(52) U.S. Cl.
CPC ..... *G09G 3/2007* (2013.01); *G09G 2310/06* (2013.01); *G09G 2320/029* (2013.01); *G09G 2320/0233* (2013.01)

(58) Field of Classification Search
None
See application file for complete search history.

(56) References Cited

U.S. PATENT DOCUMENTS 10,074,318 B2 9/2018 Zhang et al.
10,127,879 B2 11/2018 Ahn et al.
(Continued)

FOREIGN PATENT DOCUMENTS

CN 103489405 A 1/2014
CN 103943080 A 7/2014
(Continued)

OTHER PUBLICATIONS

First Office Action, including Search Report, for Chinese Patent Application No. 201710166457.3, dated Sep. 27, 2018, 23 pages.
(Continued)

*Primary Examiner* — Christopher J Kohlman
(74) *Attorney, Agent, or Firm* — Westman, Champlin & Koehler, P.A.

(57) ABSTRACT

The present disclosure discloses a grayscale signal compensation unit, a grayscale signal compensation method, a source driver, and a display apparatus. The grayscale signal compensation unit comprises: a compensation coefficient determination sub-unit configured to determine a compensation coefficient according to a position of a pixel to be driven; an inquiry sub-unit configured to inquire a reference compensation value corresponding to the initial grayscale signal according to a pre-stored grayscale compensation correspondence table for a row of pixels farthest from the source driving circuit, wherein the grayscale compensation correspondence table contains different grayscale signals and corresponding reference compensation values thereof; a calculation sub-unit configured to calculate an actual compensation value corresponding to the pixel to be driven according to the compensation coefficient and the inquired reference compensation value; and a compensation sub-unit configured to compensate for the initial grayscale signal according to the actual compensation value.

13 Claims, 2 Drawing Sheets

(56) References Cited

U.S. PATENT DOCUMENTS

| | | | | |
|---|---|---|---|---|
| 2012/0182332 | A1 | 7/2012 | Liu | |
| 2015/0022512 | A1* | 1/2015 | Ahn | G09G 3/3607 345/212 |
| 2015/0255025 | A1 | 9/2015 | Chen et al. | |
| 2015/0325170 | A1 | 11/2015 | Jeon et al. | |

FOREIGN PATENT DOCUMENTS

| | | | |
|---|---|---|---|
| CN | 104064157 | A | 9/2014 |
| CN | 104299552 | A | 1/2015 |
| CN | 104505043 | A | 4/2015 |
| CN | 105139809 | A | 12/2015 |

OTHER PUBLICATIONS

Second Office Action, including Search Report, for Chinese Patent Application No. 201710166457.3, dated May 23, 2019, 21 pages.

* cited by examiner

GRAYSCALE SIGNAL COMPENSATION UNITS, GRAYSCALE SIGNAL COMPENSATION METHODS, SOURCE DRIVERS, AND DISPLAY APPARATUSES

CROSS-REFERENCE TO RELATED APPLICATION(S)

This application claims priority to the Chinese Patent Application No. 201710166457.3, filed on Mar. 20, 2017, entitled "GRAYSCALE SIGNAL COMPENSATION UNITS, GRAYSCALE SIGNAL COMPENSATION METHODS, SOURCE DRIVERS, AND DISPLAY APPARATUSES," which is incorporated herein by reference in its entirety.

TECHNICAL FIELD

The present disclosure relates to the field of display technology, and more particularly, to a grayscale signal compensation unit, a grayscale signal compensation method, a source driver, and a display apparatus.

BACKGROUND

With the continuous development of display technology, display apparatuses with a large size, a high resolution and a high refresh rate have become a hot spot in the field of display.

In a conventional display apparatus, a source driving circuit is provided on one side (generally a lower side) of a display panel, and when the source driving circuit charges pixels through data lines, as a distance between a pixel and the source driving circuit becomes large, resistance of a data line and capacitance between the data line and a common electrode increase, that is, a Resistance Capacitance (RC) delay deteriorates. As can be seen from the above, a charging rate of the pixel on the display panel in a bottom-up direction gradually decreases, thereby resulting in a gradual decrease in brightness of the display panel in the bottom-up direction and non-uniform display brightness of the display panel.

SUMMARY

The present disclosure aims to solve at least one of the technical problems that exist in the related art and propose a grayscale signal compensation unit, a grayscale signal compensation method, a source driver, and a display apparatus.

In order to achieve the above purposes, at least one embodiment of the present disclosure provides a grayscale signal compensation unit connected to a source driving circuit to compensate for an initial grayscale signal output by the source driving circuit, the grayscale signal compensation unit comprising:

a compensation coefficient determination sub-unit configured to determine a compensation coefficient according to a position of a pixel to be driven;

an inquiry sub-unit configured to inquire a reference compensation value corresponding to the initial grayscale signal according to a pre-stored grayscale compensation correspondence table for a row of pixels farthest from the source driving circuit, wherein the grayscale compensation correspondence table contains different grayscale signals and corresponding reference compensation values thereof;

a calculation sub-unit configured to calculate an actual compensation value corresponding to the pixel to be driven according to the compensation coefficient and the inquired reference compensation value; and a compensation sub-unit configured to compensate for the initial grayscale signal according to the actual compensation value.

In an embodiment, the compensation coefficient determination sub-unit is further configured to determine the compensation coefficient K(i) according to the following equation:

$$K(i)=\begin{cases}0 & 1\le i\le s\\ \left[\dfrac{\mathrm{int}\left(\frac{i-s}{m}\right)}{\mathrm{int}\left(\frac{n-s}{m}\right)}\right]^{A} & s<i<n\\ 1 & i=n\end{cases}$$

where n is a row number corresponding to the row of pixels farthest from the source driving circuit, i is a row number of the pixel to be driven and $1\le i\le n$, s is a preset critical row number, m is a preset compensation accuracy, both of s and m are integers, A is a preset exponential value and A>0, and int( ) is a rounding function.

In an embodiment, the compensation coefficient determination sub-unit is further configured to inquire a compensation coefficient corresponding to a row number of the pixel to be driven from a preset row number and coefficient correspondence table, wherein the row number and coefficient correspondence table contains different row numbers and corresponding compensation coefficients thereof.

In an embodiment, the calculation sub-unit is further configured to calculate the actual compensation value q according to the following equation:

$$q=K(i)*Q$$

where K(i) is the compensation coefficient corresponding to the pixel to be driven, and Q is the reference compensation value.

In an embodiment, the grayscale signal compensation unit further comprises:

a storage sub-unit configured to store the grayscale compensation correspondence table for the row of pixels farthest from the source driving circuit.

In an embodiment, the grayscale signal compensation unit further comprises:

a receiving sub-unit configured to receive the initial grayscale signal output by the source driving circuit and provide the initial grayscale signal to the inquiry sub-unit and the compensation sub-unit, respectively.

In an embodiment, the grayscale signal compensation unit further comprises:

an output sub-unit configured to output the compensated initial grayscale signal to the pixel to be driven through a corresponding data line.

In order to achieve the above purposes, at least one embodiment of the present disclosure provides a grayscale signal compensation method, comprising steps of:

determining a compensation coefficient according to a position of a pixel to be driven;

inquiring a reference compensation value corresponding to an initial grayscale signal output by the source driving circuit according to a pre-stored grayscale compensation correspondence table for a row of pixels farthest from the source driving circuit, wherein the grayscale compensation correspondence table contains different grayscale signals and corresponding reference compensation values thereof;

calculating an actual compensation value corresponding to the pixel to be driven according to the compensation coefficient and the inquired reference compensation value; and compensating for the initial grayscale signal according to the actual compensation value.

In an embodiment, the step of determining a compensation coefficient according to a position of a pixel to be driven comprises a step of:

determining, by the compensation coefficient determination sub-unit, the compensation coefficient K(i) according to the following equation:

$$K(i)=\begin{cases}0 & 1\le i\le s\\ \left[\dfrac{\mathrm{int}\left(\frac{i-s}{m}\right)}{\mathrm{int}\left(\frac{n-s}{m}\right)}\right]^{A} & s<i<n\\ 1 & i=n\end{cases}$$

where n is a row number corresponding to the row of pixels farthest from the source driving circuit, i is a row number of the pixel to be driven and $1\le i\le n$, s is a preset critical row number, m is a preset compensation accuracy, both of s and m are integers, A is a preset exponential value and $A>0$, and int( ) is a rounding function.

In an embodiment, the step of determining a compensation coefficient according to a position of a pixel to be driven comprises a step of:

inquiring a compensation coefficient corresponding to a row number of the pixel to be driven from a preset row number and coefficient correspondence table, wherein the row number and coefficient correspondence table contains different row numbers and corresponding compensation coefficients thereof.

In an embodiment, the step of calculating an actual compensation value corresponding to the pixel to be driven according to the compensation coefficient and the inquired reference compensation value comprises a step of:

calculating the actual compensation value q according to the following equation:

$$q=K(i)*Q$$

where K(i) is the compensation coefficient corresponding to the pixel to be driven, and Q is the reference compensation value.

In an embodiment, before the step of determining a compensation coefficient according to a position of a pixel to be driven, the method further comprises a step of:

receiving the initial grayscale signal output by the source driving circuit.

In an embodiment, after the step of compensating for the initial grayscale signal according to the actual compensation value, the method further comprises a step of:

outputting the compensated initial grayscale signal to the pixel to be driven through a corresponding data line.

In order to achieve the above purposes, at least one embodiment of the present disclosure provides a source driver comprising a source driving circuit and the grayscale signal compensation unit described above.

In order to achieve the above purposes, at least one embodiment of the present disclosure provides a display apparatus comprising the source driver described above.

DETAILED DESCRIPTION

In order to provide a better understanding of the technical solutions according to the present disclosure, the grayscale signal compensation unit, the grayscale signal compensation method, the source driver, and the display apparatus according to the present disclosure will be described in detail below with reference to the accompanying drawings.

Figure 1:
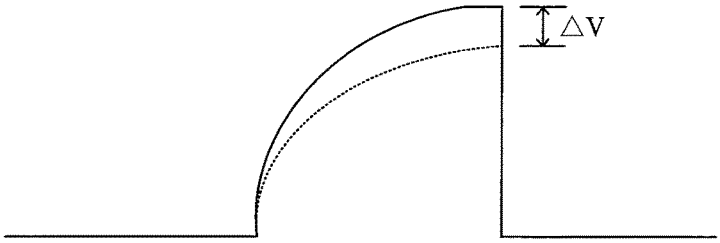
FIG. 1 is a diagram of waveforms of grayscale signals provided by a source driving circuit to pixels at different positions in the related art.

FIG. 1 is a diagram of waveforms of grayscale signals provided by a source driving circuit to pixels at different positions in the related art. As shown in FIG. 1, the solid line represents a waveform of a grayscale signal loaded by the source driving circuit to a pixel close to the source driving circuit, and the dotted line represents a waveform of a grayscale signal loaded by the source driving circuit to a pixel far from the source driving circuit. When the grayscale signal is provided to the farther pixel, due to a RC delay, a charging speed is reduced, and a target grayscale cannot be achieved in a preset charging time, that is, the charging rate is insufficient.

Figure 2:
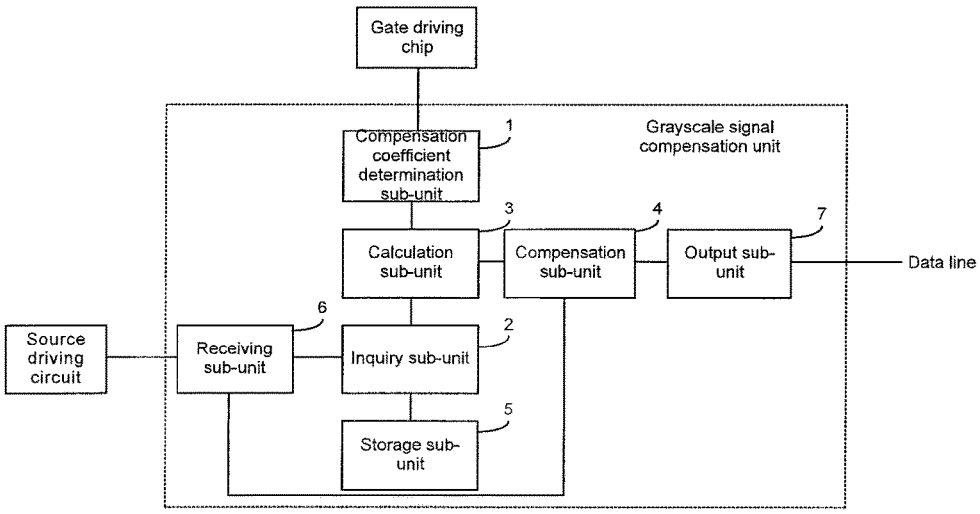
FIG. 2 is a structural diagram of a grayscale signal compensation unit according to an embodiment of the present disclosure.

FIG. 2 is a structural diagram of a grayscale signal compensation unit according to an embodiment of the present disclosure. As shown in FIG. 2, the grayscale signal compensation unit is connected to a source driving circuit to compensate for an initial grayscale signal output by the source driving circuit. The grayscale signal compensation unit comprises: a compensation coefficient determination sub-unit 1, an inquiry sub-unit 2, a calculation sub-unit 3 and a compensation sub-unit 4, wherein the calculation sub-unit 3 is connected to the inquiry sub-unit 2, the compensation coefficient determination sub-unit 1 and the compensation sub-unit 4. The compensation coefficient determination sub-unit 1 is configured to determine a compensation coefficient according to a position of a pixel to be driven. The inquiry sub-unit 2 is configured to inquire a reference compensation value corresponding to the initial grayscale signal according to a pre-stored grayscale compensation correspondence table for a row of pixels farthest from the source driving circuit, wherein the grayscale compensation correspondence table contains different grayscale signals and corresponding reference compensation values thereof. The calculation sub-unit 3 is configured to calculate an actual compensation value corresponding to the pixel to be driven according to the compensation coefficient and the inquired reference compensation value. The compensation sub-unit 4 is configured to compensate for the initial grayscale signal according to the actual compensation value.

In the present disclosure, the compensation coefficient determination sub-unit 1 determines the compensation coefficient of the pixel to be driven, the inquiry sub-unit 2 inquires the reference compensation value corresponding to the initial grayscale signal, and the calculation sub-unit 3 calculates, according to the determined compensation coefficient and the inquired reference compensation value, the actual compensation value to be used by the compensation sub-unit 4 to compensate for the initial grayscale signal, so as to realize equal charging rates of various rows of pixels on the display panel and uniform display brightness of the display panel.

As a specific solution for determining the compensation coefficient, the compensation coefficient determination sub-unit 1 is further configured to determine the compensation coefficient K(i) according to the following equation:

$$K(i)=\begin{cases}0 & 1\le i\le s\\ \left[\dfrac{\mathrm{int}\left(\frac{i-s}{m}\right)}{\mathrm{int}\left(\frac{n-s}{m}\right)}\right]^{A} & s<i<n\\ 1 & i=n\end{cases}$$

where n is a row number corresponding to the row of pixels farthest from the source driving circuit, i is a row number of the pixel to be driven and $1\le i\le n$, s is a preset critical row number, m is a preset compensation accuracy, both of s and m are integers and $m\le n-s$, A is a preset exponential value and $A>0$, and int( ) is a rounding function.

The compensation coefficient determination sub-unit 1 is connected to a gate driving chip in a display apparatus and is configured to acquire the row number corresponding to the pixel to be driven.

As can be seen from the above equation, when the row number of the pixel to be driven is less than or equal to s, it indicates that the pixel to be driven is close to the source driving circuit. In this case, a part of data lines located between the pixel to be driven and the source driving circuit has small resistance, capacitance between this part and a common electrode is small, and a RC delay phenomenon is not obvious. Therefore, there is no need to compensate for the pixel to be driven, and the compensation value K(i) is 0.

When the row number of the pixel to be driven is greater than s and less than n, it indicates that the pixel to be driven is far from the source driving circuit. In this case, a part of the data lines located between the pixel to be driven and the source driving circuit has large resistance, the capacitance between this part and the common electrode is large, and the RC delay phenomenon is obvious. Therefore, it needs to compensate for the pixel to be driven, and the larger the value of i, the larger the corresponding compensation coefficient K(i), where $0<K(i)\le 1$.

It should be illustrated that in the above calculation process, if A is equal to 1, the equation $$K(i)=\left[\frac{\mathrm{int}\left(\frac{i-s}{m}\right)}{\mathrm{int}\left(\frac{n-s}{m}\right)}\right]^{A}$$

may be regarded as linear calculation for the row number i; and if A is not equal to 1, the equation $$K(i)=\left[\frac{\mathrm{int}\left(\frac{i-s}{m}\right)}{\mathrm{int}\left(\frac{n-s}{m}\right)}\right]^{A}$$

may be regarded as non-linear calculation for the row number i.

When the row number of the pixel to be driven is equal to n, it indicates that the pixel to be driven belongs to the row of pixels farthest from the source driving circuit. In this case, the compensation coefficient K(i) is equal to 1.

It should be illustrated that, in practical applications, values of the critical row number s and compensation accuracy m may be correspondingly designed and adjusted according to practical requirements.

As a further specific solution for determining the compensation coefficient, the compensation coefficient determination sub-unit 1 is further configured to inquire a compensation coefficient corresponding to the row number of the pixel to be driven from a preset row number and coefficient correspondence table, wherein the row number and coefficient correspondence table contains different row numbers and corresponding compensation coefficients thereof. Table 1, as illustrated below, is the row number and coefficient correspondence table.

TABLE 1

Row number and coefficient correspondence table

| Row number of the pixel to be driven | Compensation coefficient |
|---|---|
| 1 | $K_1$ |
| 2 | $K_2$ |
| 3 | $K_3$ |
| 4 | $K_4$ |
| . . . | . . . |
| n − 1 | $K_{n-1}$ |
| n | $K_n$ |

where $0\le K_1\le K_2\le K_3 \ldots K_{m-1}\le K_n\le 1$, and values of $K_1$, $K_2$, $K_3 \ldots K_{n-1}$, and $K_n$ may be determined and adjusted according to preliminary experiments.

It should be illustrated that the above two specific algorithms for determining the compensation coefficient according to the position of the pixel to be driven are only exemplary, and do not limit the technical solutions according to the present disclosure. It is to be understood by those skilled in the art that all algorithms for calculating the compensation coefficient according to the position of the pixel to be driven should fall within the protection scope of the present disclosure and will not be described in detail here by way of example.

In the present embodiment, the grayscale signal compensation unit further comprises a storage sub-unit 5 connected to the inquiry sub-unit 2. The storage sub-unit 5 stores the grayscale compensation correspondence table for the row of pixels farthest from the source driving circuit. Table 2, as illustrated below, is the grayscale compensation correspondence table for the row of pixels farthest from the source driving circuit.

TABLE 2

Grayscale compensation correspondence table

| Grayscale | Reference compensation value |
|---|---|
| 0 | $Q_0$ |
| 1 | $Q_1$ |
| 2 | $Q_2$ |
| 3 | $Q_3$ |
| . . . | . . . |
| 254 | $Q_{254}$ |
| 255 | $Q_{255}$ |

where values of $Q_1$, $Q_2$, $Q_3 \ldots Q_{254}$ and $Q_{255}$ may be determined and adjusted according to preliminary experiments.

In the present disclosure, the inquiry sub-unit 2 may inquire a reference compensation value corresponding to a grayscale of the initial grayscale signal from the grayscale compensation correspondence table for the row of pixels farthest from the source driving circuit as a reference, for the subsequent calculation of the actual compensation value corresponding to the initial grayscale signal.

In an embodiment, the calculation sub-unit 3 is further configured to calculate the actual compensation value q according to the following equation:

$$q=K(i)*Q$$

where K(i) is the compensation coefficient corresponding to the pixel to be driven which is determined by the compensation coefficient determination sub-unit 1, and Q is the reference compensation value which is inquired by the inquiry sub-unit 2 from the grayscale compensation correspondence table.

It should be illustrated that the case in which the actual compensation value of the initial grayscale signal is equal to a product of the compensation coefficient and the reference compensation value is only an alternative solution in the present embodiment, and it is to be understood by those skilled in the art that all algorithms for calculating the actual compensation value according to the compensation coefficient and the reference compensation value should fall within the protection scope of the present disclosure and will not be described in detail here by way of example.

In the present embodiment, the grayscale signal compensation unit further comprises a receiving sub-unit 6 and an output sub-unit 7. The receiving sub-unit 6 is connected to an output terminal of the source driving circuit, the inquiry sub-unit 2 and the compensation sub-unit 4, and is configured to receive the initial grayscale signal output by the source driving circuit, and transmit the initial grayscale signal to the inquiry sub-unit 2 and the compensation sub-unit 4, respectively. The output sub-unit 7 is connected to the compensation sub-unit 4 and a data line, and is configured to receive an initial grayscale signal processed by the compensation sub-unit 4 and output the compensated initial grayscale signal to the corresponding data line to drive the pixel to be driven.

The embodiments of the present disclosure provide a grayscale signal compensation unit, comprising: a compensation coefficient determination sub-unit, an inquiry sub-unit, a calculation sub-unit and a compensation sub-unit. The compensation coefficient determination sub-unit is configured to determine a compensation coefficient according to a position of a pixel to be driven. The inquiry sub-unit is configured to inquire a reference compensation value corresponding to the initial grayscale signal according to a pre-stored grayscale compensation correspondence table for a row of pixels farthest from the source driving circuit. The calculation sub-unit is configured to calculate an actual compensation value corresponding to the pixel to be driven according to the compensation coefficient and the inquired reference compensation value. The compensation sub-unit is configured to compensate for the initial grayscale signal according to the actual compensation value. In the technical solutions according to the present disclosure, the initial grayscale signal output by the source driving circuit can be effectively compensated, to realize equal charging rates of various rows of pixels on the display panel and uniform display brightness of the display panel.

Figure 3:
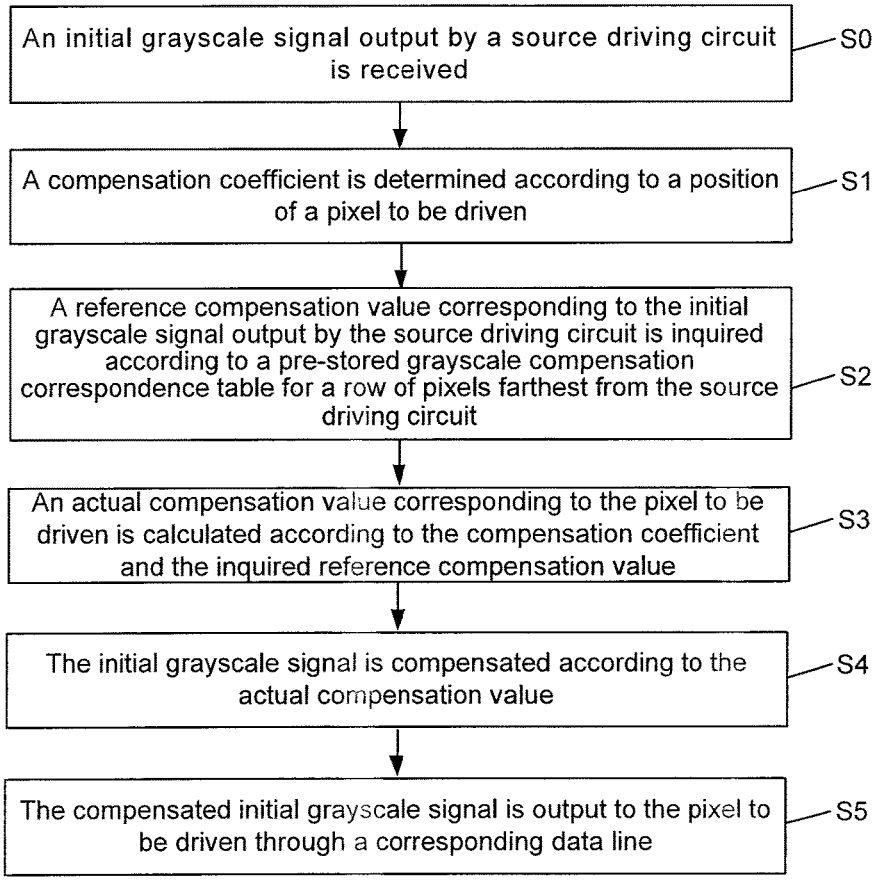
FIG. 3 is a flowchart of a grayscale signal compensation method according to an embodiment of the present disclosure.

FIG. 3 is a flowchart of a grayscale signal compensation method according to an embodiment of the present disclosure. As shown in FIG. 3, the grayscale signal compensation method comprises the following steps.

In step S1, a compensation coefficient is determined according to a position of a pixel to be driven.

In step S2, a reference compensation value corresponding to an initial grayscale signal output by the source driving circuit is inquired according to a pre-stored grayscale compensation correspondence table for a row of pixels farthest from the source driving circuit.

The grayscale compensation correspondence table contains different grayscale signals and corresponding reference compensation values thereof, and the grayscale compensation correspondence table may be stored in an independent storage sub-unit.

In an embodiment, in step S2, the compensation coefficient K(i) may be determined according to the following equation:

$$K(i)=\begin{cases} 0 & 1\le i\le s \\ \left[\dfrac{\mathrm{int}\left(\dfrac{i-s}{m}\right)}{\mathrm{int}\left(\dfrac{n-s}{m}\right)}\right]^{A} & s<i<n \\ 1 & i=n \end{cases}$$

where n is a row number corresponding to the row of pixels farthest from the source driving circuit, i is a row number of the pixel to be driven and $1\le i\le n$, s is a preset critical row number, m is a preset compensation accuracy, both of s and m are integers and $m\le n-s$, A is a preset exponential value and $A>0$, and int( ) is a rounding function.

In an embodiment, in step S2, a compensation coefficient corresponding to the row number of the pixel to be driven may be inquired from a preset row number and coefficient correspondence table, wherein the row number and coefficient correspondence table contains different row numbers and corresponding compensation coefficients thereof.

In step S3, an actual compensation value corresponding to the pixel to be driven is calculated according to the compensation coefficient and the inquired reference compensation value.

In an embodiment, in step S3, the actual compensation value q may be calculated according to the following equation:

$$q=K(i)*Q$$

where K(i) is the compensation coefficient corresponding to the determined pixel to be driven, and Q is the reference compensation value inquired from the grayscale compensation correspondence table.

In step S4, the initial grayscale signal is compensated according to the actual compensation value.

It should be illustrated that the process of compensating for a signal according to a compensation value is a commonly-used technical measure in the art, and will not be described in detail here.

In addition, in the present embodiment, before step S1, the method further comprises the following step S0.

In step S0, the initial grayscale signal output by the source driving circuit is received.

In an embodiment, after step S4, the method further comprises the following step S5.

In step S5, the compensated initial grayscale signal is output to the pixel to be driven through a corresponding data line.

The embodiments of the present disclosure provide a grayscale signal compensation method, comprising: determining a compensation coefficient according to a position of a pixel to be driven; inquiring a reference compensation value corresponding to an initial grayscale signal according to a pre-stored grayscale compensation correspondence table for a row of pixels farthest from the source driving circuit; calculating an actual compensation value corresponding to the pixel to be driven according to the compensation coefficient and the inquired reference compensation value; and compensating for the initial grayscale signal according to the actual compensation value. In the technical solutions according to the present disclosure, the initial grayscale signal output by the source driving circuit can be effectively compensated, so as to realize equal charging rates of various rows of pixels on a display panel and uniform display brightness of the display panel.

The embodiments of the present disclosure provide a source driver comprising a source driving circuit and a grayscale signal compensation unit, wherein the grayscale signal compensation unit adopts the grayscale signal compensation unit according to the embodiments described above and compensates for an initial grayscale signal output by the source driver based on the grayscale signal compensation method according to the embodiments. The details can be found in the description of the embodiments described above, and will not be described in detail here.

The embodiments of the present disclosure provide a display apparatus comprising a source driver, wherein the source driver adopts the source driver according to the embodiments described above.

In the present embodiment, the display apparatus may be a liquid crystal display apparatus or an organic electroluminescent display apparatus, for example, any product or component having a display function such as an electronic paper, a mobile phone, a tablet computer, a television set, a display, a notebook computer, a digital photo frame, a navigator etc.

It is to be understood that the above embodiments are merely illustrative embodiments for the purpose of illustrating the principles of the present disclosure; however, the present disclosure is not limited thereto. It will be apparent to those skilled in the art that various changes and modifications can be made therein without departing from the spirit and essence of the present disclosure, and these changes and modifications are also regarded to fall within the protection scope of the present disclosure.

We claim:

1. A grayscale signal compensation unit connected to a source driving circuit to compensate for an initial grayscale signal output by the source driving circuit, the grayscale signal compensation unit comprising:

a compensation coefficient determination sub-unit configured to determine a compensation coefficient according to a position of a pixel to be driven;

an inquiry sub-unit configured to inquire a reference compensation value corresponding to the initial grayscale signal according to a pre-stored grayscale compensation correspondence table for a row of pixels farthest from the source driving circuit, wherein the grayscale compensation correspondence table contains different grayscale signals and corresponding reference compensation values thereof;

a calculation sub-unit configured to calculate an actual compensation value corresponding to the pixel to be driven according to the compensation coefficient and the inquired reference compensation value; and a compensation sub-unit configured to compensate for the initial grayscale signal according to the actual compensation value, wherein the compensation coefficient determination sub-unit is further configured to determine the compensation coefficient K(i) according to the following equation:

$$K(i)=\begin{cases}0 & 1\le i\le s\\ \left[\dfrac{\mathrm{int}\left(\frac{i-s}{m}\right)}{\mathrm{int}\left(\frac{n-s}{m}\right)}\right]^{A} & s<i<n\\ 1 & i=n\end{cases}$$

where n is a row number corresponding to the row of pixels farthest from the source driving circuit, i is a row number of the pixel to be driven and $1\le i\le n$, s is a preset critical row number, m is a preset compensation accuracy, both of s and m are integers, A is a preset exponential value and A>0, and int( ) is a rounding function.

2. The grayscale signal compensation unit according to claim 1, wherein the compensation coefficient determination sub-unit is further configured to inquire a compensation coefficient corresponding to a row number of the pixel to be driven from a preset row number and coefficient correspondence table, wherein the row number and coefficient correspondence table contains different row numbers and corresponding compensation coefficients thereof.

3. The grayscale signal compensation unit according to claim 1, wherein the calculation sub-unit is further configured to calculate the actual compensation value q according to the following equation:

$$q=K(i)*Q$$

where K(i) is the compensation coefficient corresponding to the pixel to be driven, and Q is the reference compensation value.

4. The grayscale signal compensation unit according to claim 1, further comprising:

a storage sub-unit configured to store the grayscale compensation correspondence table for the row of pixels farthest from the source driving circuit.

5. The grayscale signal compensation unit according to claim 1, further comprising:

a receiving sub-unit configured to receive the initial grayscale signal output by the source driving circuit and provide the initial grayscale signal to the inquiry sub-unit and the compensation sub-unit, respectively.

6. The grayscale signal compensation unit according to claim 1, further comprising:

an output sub-unit configured to output the compensated initial grayscale signal to the pixel to be driven through a corresponding data line.

7. A grayscale signal compensation method, comprising steps of:

determining a compensation coefficient according to a position of a pixel to be driven;

inquiring a reference compensation value corresponding to an initial grayscale signal output by the source driving circuit according to a pre-stored grayscale compensation correspondence table for a row of pixels farthest from the source driving circuit, wherein the grayscale compensation correspondence table contains different grayscale signals and corresponding reference compensation values thereof;

calculating an actual compensation value corresponding to the pixel to be driven according to the compensation coefficient and the inquired reference compensation value; and compensating for the initial grayscale signal according to the actual compensation value, wherein the step of determining a compensation coefficient according to a position of a pixel to be driven comprises a step of:

determine the compensation coefficient K(i) according to the following equation:

$$K(i)=\begin{cases}0 & 1\le i\le s\\ \left[\dfrac{\mathrm{int}\left(\frac{i-s}{m}\right)}{\mathrm{int}\left(\frac{n-s}{m}\right)}\right]^{A} & s<i<n\\ 1 & i=n\end{cases}$$

where n is a row number corresponding to the row of pixels farthest from the source driving circuit, i is a row number of the pixel to be driven and $1\le i\le n$, s is a preset critical row number, m is a preset compensation accuracy, both of s and m are integers, A is a preset exponential value and A>0, and int( ) is a rounding function.

8. The grayscale signal compensation method according to claim 7, wherein the step of determining a compensation coefficient according to a position of a pixel to be driven comprises a step of:

inquiring a compensation coefficient corresponding to a row number of the pixel to be driven from a preset row number and coefficient correspondence table, wherein the row number and coefficient correspondence table contains different row numbers and corresponding compensation coefficients thereof.

9. The grayscale signal compensation method according to claim 7, wherein the step of calculating an actual compensation value corresponding to the pixel to be driven according to the compensation coefficient and the inquired reference compensation value comprises a step of:

calculating the actual compensation value q according to the following equation:

$$q=K(i)*Q$$

where K(i) is the compensation coefficient corresponding to the pixel to be driven, and Q is the reference compensation value.

10. The grayscale signal compensation method according to claim 7, wherein before the step of determining a compensation coefficient according to a position of a pixel to be driven, the method further comprises a step of:

receiving the initial grayscale signal output by the source driving circuit.

11. The grayscale signal compensation method according to claim 7, wherein after the step of compensating for the initial grayscale signal according to the actual compensation value, the method further comprises a step of:

outputting the compensated initial grayscale signal to the pixel to be driven through a corresponding data line.

12. A source driver comprising a source driving circuit and the grayscale signal compensation unit according to claim 1.

13. A display apparatus comprising the source driver according to claim 12.

* * * * *